US006305115B1

(12) United States Patent
Cook

(10) Patent No.: US 6,305,115 B1
(45) Date of Patent: Oct. 23, 2001

(54) GEL RECOIL PAD

(75) Inventor: Todd D. Cook, Ekron, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 09/124,438

(22) Filed: Jul. 29, 1998

(51) Int. Cl.[7] ..... F41C 23/00
(52) U.S. Cl. ..... 42/74
(58) Field of Search ..... 42/74

(56) References Cited

U.S. PATENT DOCUMENTS

| | | | | |
|---|---|---|---|---|
| D. 105,358 | | 7/1937 | Anderson . | |
| D. 158,745 | | 5/1950 | Harbeke | D30/1 |
| D. 162,217 | | 2/1951 | Pachmayr | D30/1 |
| D. 192,922 | | 5/1962 | Pachmayr et al. | D30/1 |
| 202,606 | | 4/1878 | Thornton et al. . | |
| D. 376,188 | | 12/1996 | Riecken | D22/111 |
| 2,091,010 | | 8/1937 | Pachmayr | 42/74 |
| 2,667,005 | | 1/1954 | Weis | 42/74 |
| 3,147,562 | | 9/1964 | Pachmayr et al. | 42/74 |
| 3,263,359 | * | 8/1966 | Pachmayr | 42/74 |
| 3,696,544 | | 10/1972 | Webb | 42/74 |
| 3,714,726 | * | 2/1973 | Braun | 42/74 |
| 3,977,923 | * | 8/1976 | Uelzmann | 149/19.1 |
| 4,504,604 | | 3/1985 | Pilkington et al. | 523/167 |
| 4,512,101 | * | 4/1985 | Waterman, Jr. | 42/74 |
| 4,551,937 | | 11/1985 | Seehase | 42/74 |
| 4,683,671 | * | 8/1987 | Farrar | 42/74 |
| 4,732,075 | * | 3/1988 | Hurd | 89/44.02 |
| 4,887,374 | * | 12/1989 | Santarossa | 42/74 |
| 4,910,904 | | 3/1990 | Rose | 42/74 |
| 4,922,641 | | 5/1990 | Johnson | 42/74 |
| 4,956,932 | * | 9/1990 | Cupp | 42/74 |
| 4,982,521 | * | 1/1991 | Sutton et al. | 42/74 |
| 4,998,367 | | 3/1991 | Leibowitz | 42/71.02 |
| 5,235,765 | * | 8/1993 | Chesnut | 42/74 |
| 5,265,366 | * | 11/1993 | Thompson | 42/74 |
| 5,435,092 | * | 7/1995 | Bordie | 42/104 |
| 5,461,813 | | 10/1995 | Mazzola | 42/74 |
| 5,471,776 | | 12/1995 | Chesnut et al. | 42/74 |
| 5,634,289 | * | 6/1997 | Wascher | 42/74 |
| 5,669,168 | * | 9/1997 | Perry | 42/74 |
| 6,026,527 | * | 2/2000 | Pearce | 5/654 |

OTHER PUBLICATIONS

Akton Energy Absorber Mag–Kick Killer™ by Action Products, Inc., product discovered Summer 1997.
Kick–Eez Recoil Pad by Sorbothane, Inc., product discovered in 1997, Shotgun Report by The Technoid from www-.shotgunreport.com.

* cited by examiner

*Primary Examiner*—Charles T. Jordan
*Assistant Examiner*—Denise J Buckley
(74) *Attorney, Agent, or Firm*—Huntley & Associates

(57) ABSTRACT

The present invention relates to a recoil pad for a firearm. The recoil pad includes a solid viscoelastic core, preferably formed using a polymer gel, and having a cross sectional shape substantially similar to that of the stock to which the recoil pad is mounted. The recoil pad further includes a covering enclosing at least a portion of the core with the covering having substantially the same shape as the core.

18 Claims, 2 Drawing Sheets

GEL RECOIL PAD

BACKGROUND OF THE INVENTION

1. Field of the Invention

The present invention relates generally to shock attenuating devices for firearms. More particularly, the invention relates to a pad to reduce recoil force felt by a firearm user.

2. Description of the Prior Art

Recoil pads have been used for more than a century on shoulder-fired firearms to disperse the force generated during firing. Ammunition developments over the years have resulted in higher projectile velocities and projectile weights. These developments combined with lighter gun weights have led to a sometimes wearisome and painful increase in recoil force felt by the user. Although the increase in this "felt recoil" occurs in all shoulder-fired firearms, the problem particularly is troubling for shotgun shooters using heavy loads such as turkey magnums or heavy water fowl loads.

Recoil pads serve secondary functions in addition to those discussed above. For example, they may also be used to adjust stock length and prevent the firearm from slipping on the shoulder during firing.

The history of firearm design has seen many different approaches to recoil pad design. Early efforts were directed to attaching a soft material such as rubber at the end of the gun stock. Solid rubber pads are still commonly used for addressing felt recoil. Rubber provides some amount of dampening and dissipation of recoil force, but does not absorb recoil. Solid rubber recoil pads are available in a variety of degrees of cross link density values so that the pads may vary from being quite compressible to very hard. The softer rubber pads have the disadvantage of being unstable and susceptible to hardening with exposure to sunlight and heat. Also, soft rubber will smudge garments and attract dirt. Harder rubber compositions do not suffer as much from this disadvantage. Solid rubber recoil pads may be sanded to conform to the shape of a firearm stock.

Vented rubber recoil pads were intended to overcome the problems with solid rubber pads by providing energy absorbing voids in the pad structure. The open, relatively thin-walled structures were designed to compress under the firearm's recoil force in a controlled manner in an effort to absorb the recoil force and lessen the felt recoil. The voids or open structures may be open and visible to the shooter or may be hidden inside the pad, such as those made by Pachmayr, Ltd., of Monrovia, Calif. Vented rubber pads offer improved performance over rubber pads but at a tradeoff of higher manufacturing costs. Moreover, the thin-walled structures making up the void areas deteriorate with use.

Yet another approach is an attempt to redirect the force, such as the use of a thin fluid in an open cellular structure. This arrangement attempts to direct some of the forces normal to the direction of recoil via fluid flow and absorb them through frictional losses within the fluid. Unfortunately, the amount of force redirection is limited because fluid transport within the structure is small. Large fluid transport could occur by using a thin bag of water with no cellular structure to restrict flow. Under this arrangement, however, the fluid is transported too quickly resulting in a higher felt recoil force at the end of the rearward stroke. If this fluid could be viscoelastic with an appropriate amount of elasticity, the felt recoil could be reduced by redirecting the force and keep the felt recoil low through the entire recoil event.

These prior solutions have not succeeded in optimally reducing the felt recoil, while keeping the recoil pad simple and lightweight. While solid recoil pads have some advantages and could reduce recoil by adding to the overall weight of the firearm, disadvantages result as well. Heavy recoil pads increase the overall weight of the firearm and can impact adversely the firearm's accuracy by shifting the balance of the firearm rearwardly. Compressible recoil pads do not reduce the amount of force generated during firing, but change the characteristics of how that force is felt by the shooter. As these types of pads compress, they transform the sharp instantaneous push of the recoil force into a more attenuated sensation. As the recoil pad compresses, it permits the comb of the firearm stock to move rearwardly along the shooter's cheekbone. This rearward movement is sometimes referred to in the art as "face slap" and, if excessive, can be quite uncomfortable for the shooter. Moreover, excessive rearward travel of the entire firearm during firing negatively affects accuracy.

There remains a need then for a recoil pad that is functional, simple, lightweight and attractive to users, and that also reduces the felt recoil.

SUMMARY OF THE INVENTION

The present invention relates to a gel-filled recoil pad. A recoil pad for mounting on the stock of a firearm is provided, and comprises a solid viscoelastic core having a cross sectional shape substantially similar to that of the stock. A covering surrounds and supports the core. The viscoelastic core can be comprised of a gel.

These and other aspects of the present invention will become apparent to those skilled in the art after a reading of the following description of the preferred embodiment when considered with the drawings.

DESCRIPTION OF THE PREFERRED EMBODIMENTS

Figure 1:
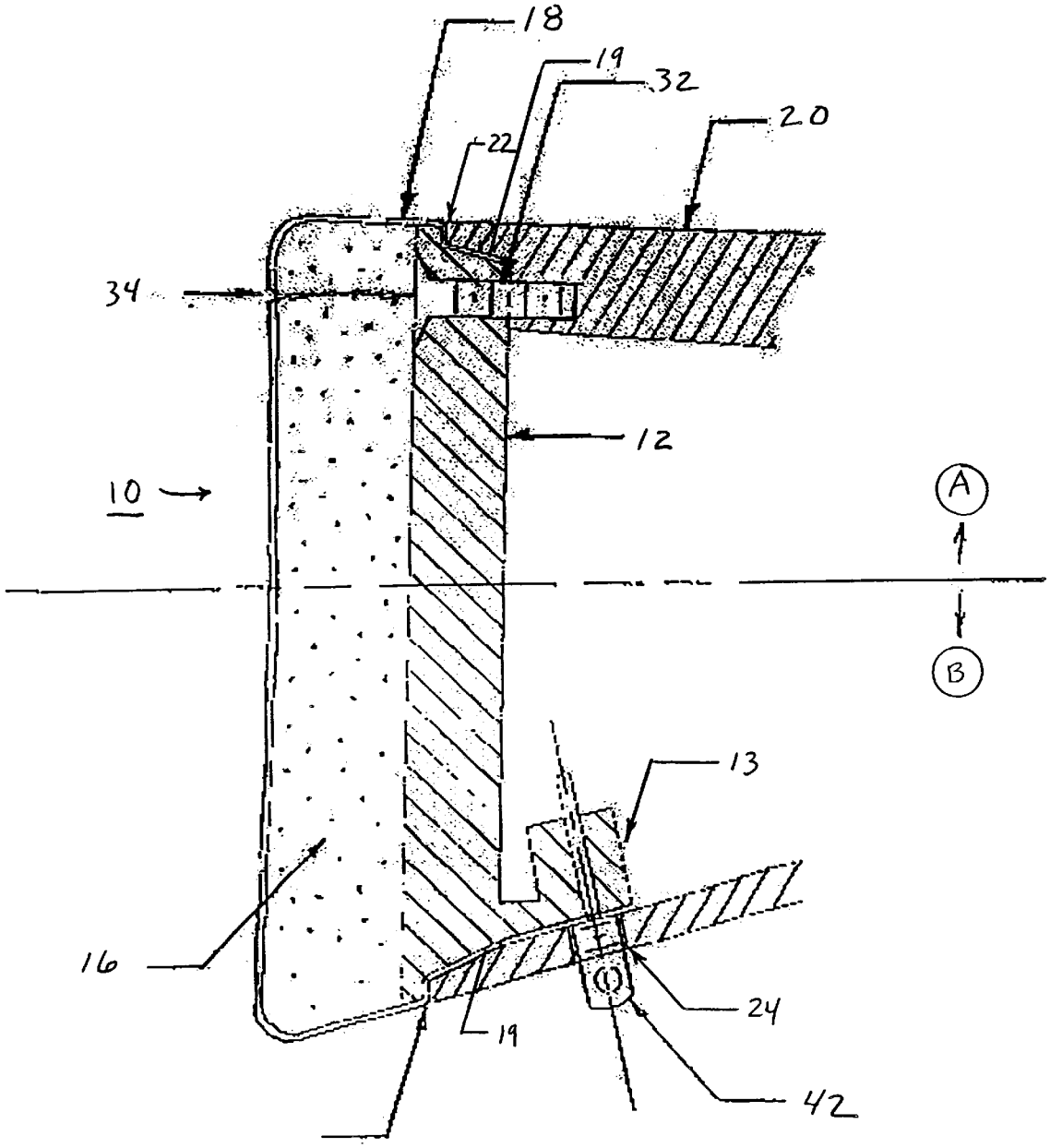
FIG. 1 is a partial cut-away side view of the recoil pad of the present invention attached to the end of a gunstock.
Figure 2:
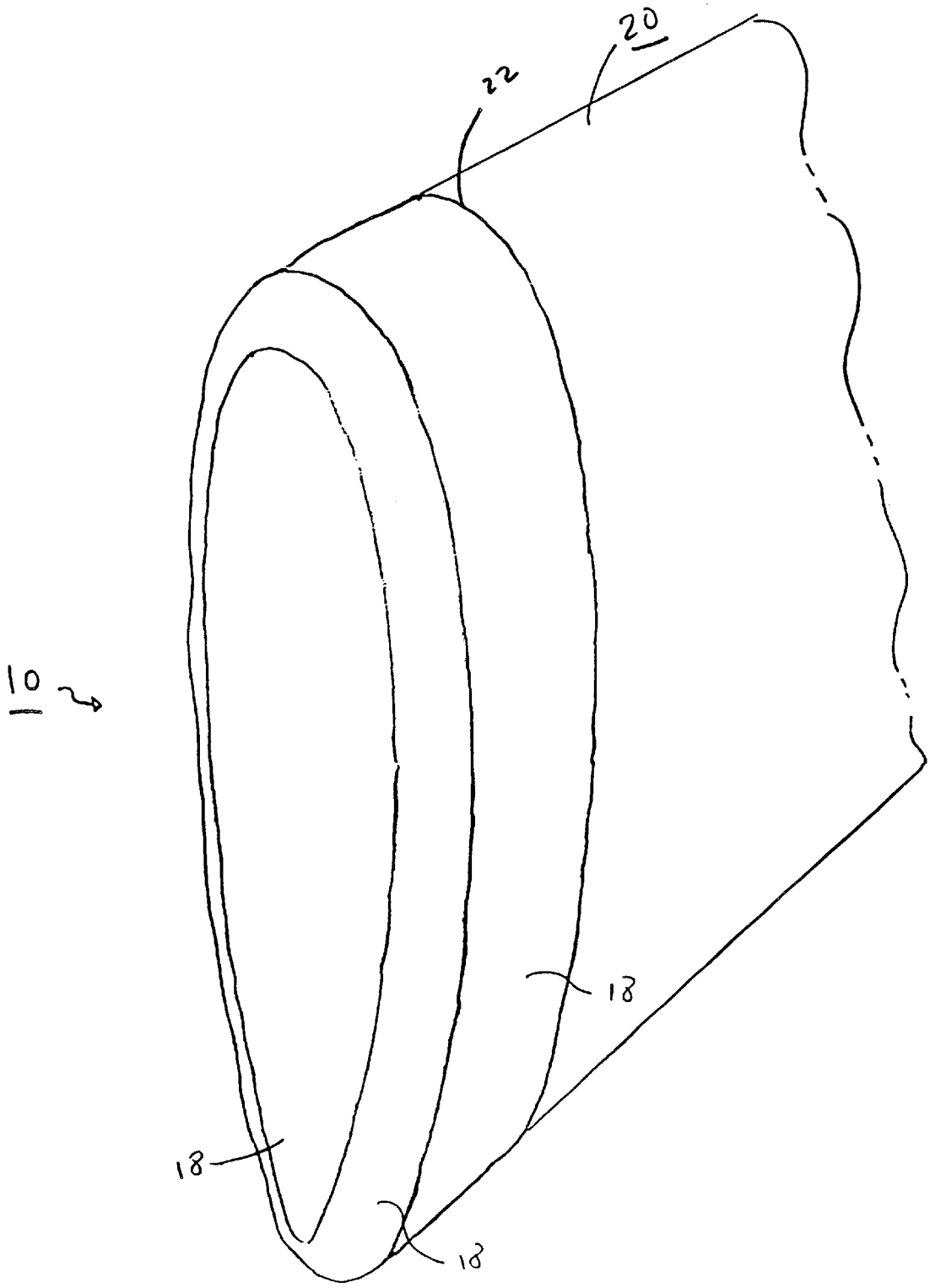
FIG. 2 is a perspective view of the recoil pad of the present invention viewed from the end of a gunstock.

In the preferred embodiment depicted in FIGS. 1–2, the recoil pad of the present invention is indicated generally at 10 and shown mounted to the stock 20 along its butt end 22. Recoil pad 10 includes a solid viscoelastic core 16 having a cross sectional shape substantially similar to that of stock 20 at its butt end 22. Viscoelastic core 16 is covered and partially supported by covering 18. Covering 18 may be secured to a semi-rigid backer 12 for secure mounting to stock 20. The term "semi-rigid" refers to a sufficient amount of rigidity to provide a firm support for covering 18 and core 16, yet having sufficient pliability to conform to whatever curvature may be present in the butt end 22 of stock 20.

Covering 18 preferably is thermoformed and comprised of a thin polymer film having a thickness between about 0.002 inches and about 0.070 inches, after forming. Alternatively, covering 18 may be constructed from a fabric such as woven polyamide fibers, polyester fibers or natural fibers having either a woven or a knit construction providing substantially the same shape as the core. Suitable polymer films for the practice of the present invention include those selected from the group consisting of polyurethane, polyethylene, polypropylene, poly (vinyl chloride) (PVC)

and polyester. Particularly preferred is a polyurethane film having a pre-forming thickness between about 0.010 and about 0.130 inches. It is believed that these materials are better adapted to being molded and shaped to conform to the shape of the core.

In a preferred embodiment, the covering is comprised of poly(ether urethane). This material was found to be sufficiently tear-resistant and resistant to degradation due to UV absorption. A suitable source of a preferred covering is a product identified as 9200 series (AT9210), sold by Deerfield Urethane, Inc., located in Whately, Mass.

Some viscoelastic cores can have a sticky surface, undesirable to the touch. The covering enhances the durability and customer acceptance of the gel core construction. The covering may be thermoformed, blow molded, rotational molded, injection molded, or cast, or even applied as a dip or sprayed on coating.

Nevertheless, it should be appreciated that this invention includes an embodiment without the covering 18. The solid viscoelastic core 16 would function in accordance with the requirements of this invention without a covering.

The recoil pad may be mounted to the firearm stock through any number of fastener systems. Two embodiments are shown in FIG. 1. Embodiment A, shown on the upper portion of FIG. 1, depicts a mounting means using a threaded member 32. In one form of this embodiment, threaded member 32 is inserted through the core 16 at insertion position 34, and fastened through the semi-rigid backer 12 into the stock 20. The viscoelastic core "self heals" behind the threaded member 32. Additional insertion points and threaded members can be used for increased mounting strength. Alternatively, threaded member 32 can be installed in place first, followed by the core 16, then covering 18. In either event, embodiment A depicts one method that can be used for mounting of the recoil pad for existing firearms in a retrofit installation.

A second embodiment B for a mounting system is also shown in FIG. 1, lower half. Here, the backer 12 is mounted to the stock 20 by extending a swivel stud 42 into a threaded opening 24 of the stock. The backer 12 has a receiving member 13, into which the swivel stud 42 is secured. By unscrewing the swivel stud 42 and pulling it out, the backer 12 is free to be easily removed from the stock 20.

The covering 18 has edges 19 that are tucked between the backer 12 and stock 20, when secured by either embodiment A or B of FIG. 1. This feature allows the covering 18 to secure the core 16, and prevent the core 16 from falling off the backer 12 or stock 20. Such a securing method allows the avoidance of special adhesive or fastener of the core 16 to the backer 12.

A number of alternative fastener systems may also be employed in the practice of the present invention. For example, adhesives, screws or VELCRO® hook and loop fasteners may be used. Also, a press-fit or snap-fit arrangement could be used as well. For firearms having stocks constructed from synthetic or composite materials, the molding process used to manufacture the stock could include the provision of a recoil pad cavity. The cavity would permit the easy installation of gel recoil pads of varying thickness or hardness depending on a shooter's personal preferences.

The scope of the present invention includes using these and other equivalent means for attaching the pad to the firearm. The particular means for fastening will vary depending on the conditions under which the firearm will be used. For example, a very secure fastening system may be required for turkey hunting in dense foliage while a less secure system may be appropriate for clay target shooting.

The viscoelastic core 16 should be comprised of a material having the ability to dampen recoil force without affecting the performance of the firearm as described above. The preferred material for this function is a polyurethane gel having a cross link density similar to that of the gels used for medical orthopedic applications. Lower cross link density results in a softer gel than would be used for direct skin application and also a gel that may be sticky to touch. Thus, an additional function of covering 18 is to make some of the characteristics of viscoelastic core 16 more acceptable to the consumer.

Suitable polyurethane gels for the practice of the present invention preferably have a Shore 00 hardness value between about 60 and about 90. As is well known in the art, a hardness value is obtained by use of a durometer, such as the Shore® 00 durometer.

In a preferred embodiment, the viscoelastic core portion of the recoil pad has a thickness of about 1 inch measured laterally from butt end 22 of stock 20. This thickness may be tapered slightly near the top and bottom of the stock 20 as shown if FIG. 2. Other thicknesses may be used depending on the performance desired and the desire to alter the stock length of the firearm. A preferred gel is that available from Pittsburgh Plastics Manufacturing Co., Zelienople, Pa., under the designation ISOGEL®.

The characteristics of the preferred gels for the present invention were determined during qualitative and quantitative testing. The qualitative testing concerned subjective impressions of test participants. Testing was conducted using three groups of shooters, each group having an average weight of about 150 pounds, 200 pounds and 250 pounds. Each shooter fired a Remington Model 870 shotgun, in 12-guage having a light contour barrel and a magnum receiver. The test rounds included the Remington 2¾" NITRO 27™ handicap trap load and the Remington 3"Premier Turkey Magnum. Additionally, each shooter fired 10 rounds of each load. Five different recoil pads were tested to include a solid rubber pad, a vented rubber pad and gel pads of varying hardness values. Shooters were asked to rank the performance of each recoil pad, from best (score of "1") to worst ("5"), with the results shown in Table 1 below.

TABLE 1

| | Qualitative Testing | | |
|---|---|---|---|
| Pad Type | 150# Shooter | 200# Shooter | 250# Shooter |
| Solid Rubber | 5 | 5 | 5 |
| Vented Rubber | 3 | 2 | 3 |
| Gel (00-60) | 2 | 3 | 1 |
| Gel (00-75) | 4 | 4 | 4 |
| Gel (00-90) | 1 | 1 | 2 |

Quantitative tests examined forces using Kistler® Model 9712A500 dynamic load cells and a high resolution PCB® accelerometer. Table 2 below compares the measured forces for three different gel compositions to that for the solid and vented rubber recoil pads. The test results are shown as an average for shooters weighing 150, 200 and 250 pounds. Gel formations Shore hardness (00) values for Gels 1, 2 and 3 are 60, 75 and 90, respectively.

TABLE 2

| Quantitative Results: Forces for Various Shooters and Loads | | | | | |
|---|---|---|---|---|---|
| Load | Solid | Vented | Gel 1 (60) | Gel 2 (75) | Gel 3 (90) |
| Lt. Target | 208 | 198 | 16D | 176 | 167 |
| Turkey | 365 | 333 | 328 | 312 | 327 |

The gel recoil pads produced a recoil force reduction of 19% for light target loads and a reduction of 6% for Turkey Magnum 3 inch loads. The smaller improvement for the turkey load is due to its much higher impulse.

The data in the tables above demonstrate the advantages and unexpected results of the present invention. The specific gel hardness values illustrate the invention in an exemplary fashion and should not be construed as limiting the scope of the invention.

Thickness of the covering material within the ranges specified above seemed to have little affect on performance, although there were some differences. Test data for a single shooter weighing 250 pounds, shooting a light target load, are summarized in Table 3 below:

TABLE 3

| Forces for Various Covering Thickness Values | | | |
|---|---|---|---|
| Cover Thickness (inches) | 0.000 | 0.020 | 0.030 |
| Force | 173 | 176 | 179 |

The test results indicate that an increase in covering thickness affects recoil pad performance slightly.

The test results illustrate the improved performance of the present invention compared to solid and vented rubber recoil pads.

Based on these test results, it is believed that a gel stiffness of about 60 Shore 00 hardness is best for light shotgun loads including target loads and light field loads for quail or dove. A stiffness value of about 90 is preferred for heavy loads such as turkey magnums or heavy water foul loads. The optimization process of the gel composition and viscoelastic core thickness for a specific gun, load and shooter is within the scale of a person of ordinary skill in the art. It has been found that hardness values below about 60 Shore 00 can permit excessive rearward movement such that recoil force is not dissipated over the entire time span of firing. Gels having a hardness below this value are said to "bottom out." That is, they produce the desired attenuation effect early on during the recoil event but provide unsatisfactory performance later during the recoil event. Depending on their hold, some shooters may also experience excessive "face slap" with low hardness gels. Hardness values above about 90 Shore 00 result in a recoil pad having a lower recoil force dissipation performance similar to rubber and vented rubber pads. Use of even solid polyurethane pads, such as those manufactured by Sorbothane, can be too hard to be practical in this type of usage. Materials with hardness ratings on the Shore A scale or B scale do not function well in a firearm application where high amplitudes and low frequency loads are experienced.

This invention also includes an embodiment where the recoil pad is comprised of one or more materials, where at least one is a viscoelastic substance. For example, a recoil pad could include: a backer, such as made from ceramic or a hard or pliable plastic; a spongy open-cell or closed-cell foam, such as foam rubber; a viscoelastic material, such as a gel; and a film or fabric covering. In such an embodiment, the foam will initially displace the impact load, with the gel providing dampening effects.

A gel recoil pad according to this invention can be provided in different thicknesses in order to create adaptable length of pull. The length of pull is the distance between the end of the recoil pad and the trigger. A shooter with longer arms is often more comfortable with a longer length of pull, and a shorter shooter the opposite. By producing a plurality of different recoil pad thicknesses, the firearm manufacturer can provide a plurality of pull systems so that the firearm can easily be customized to the shooter's arm length.

The present invention may be employed in alternative embodiments for recoil force attenuation. For example, some shooting garments are provided with shoulder pockets for containing different types of protective padding. A gel pad constructed generally according to the present invention may be inserted into such a pocket to provide approximately the same type of protection. For shoulder-fired guns, this embodiment would require a larger pad because the gun is not placed on exactly the same point on the shoulder each time the gun is fired. The change in pad size may require modifying the gel hardness value to account for dissipating the recoil force over a larger area.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What I claim is:

1. A recoil pad for mounting on the stock of a firearm that deforms and rapidly returns to its original shape in response to a recoil event comprising:

a) a solid viscoelastic gel core having a cross sectional shape substantially similar to that of the stock; and b) the core having a Shore 00 hardness between about 60 and about 90.

2. A recoil pad according to claim 1 further comprising a fastener for mounting the recoil pad to the firearm stock.

3. A recoil pad according to claim 1 wherein the gel is a natural gel.

4. A recoil pad according to claim 1 that further comprises a backer adapted for mounting to the firearm stock.

5. A recoil pad according to claim 1 wherein the gel is a polymer gel.

6. A recoil pad according to claim 5 wherein the polymer gel is selected from the group consisting of polyurethane, polycarbonate urethane, polyester urethane, polyamides and silicones.

7. A recoil pad according to claim 1 wherein the gel has a Shore 00 hardness between about 60 and about 90 and the pad has a covering enclosing at least a portion of the core.

8. A recoil pad according to claim 1 wherein the core has a thickness of about 1 inch.

9. A recoil pad according to claim 7 wherein the covering is comprised of a thin polymer film.

10. A recoil pad according to claim 9 wherein the thin polymer film has a thickness of between about 0.002 and about 0.070 inches.

11. A recoil pad according to claim 9 wherein the thin polymer film is polyether polyurethane.

12. A recoil pad according to claim 7 wherein the covering is constructed of a synthetic fabric selected form the group consisting of polyester, nylon, PVC, and aramid.

13. A recoil pad according to claim 7 wherein the covering is constructed from a natural fiber.

14. A core construction for a recoil pad comprising a solid viscoelastic gel having a Shore 00 hardness value between about 60 and about 90 that deforms and rapidly returns to its original shape in response to a recoil event.

15. A core construction according to claim 14 wherein the gel is a polyurethane gel.

16. A recoil pad for mounting on the stock of a firearm that deforms and rapidly returns to its original shape in response to a recoil event comprising:

a) a solid polyurethane gel core having a Shore 00 hardness between about 60 and about 90;

b) a covering enclosing at least a portion of the core.

17. A recoil pad according to claim 16 further comprising a fastener for mounting the recoil pad to the firearm stock.

18. A recoil pad for mounting on the stock of a firearm that deforms and rapidly returns to its original shape in response to a recoil event comprising:

a) a polyurethane gel core having a cross sectional shape substantially similar to that of the stock, the gel having a Shore 00 hardness of between about 60 and about 90;

b) a flexible polyurethane film enclosing at least a portion of the core, the film having substantially the same shape as the core; and a fastening means for mounting the recoil pad to the firearm stock.

* * * * *